US006311923B1

(12) United States Patent
Tsai

(10) Patent No.: US 6,311,923 B1
(45) Date of Patent: Nov. 6, 2001

(54) COMBINATORIAL MULTI-USE TAPE DISPENSER

(76) Inventor: Ching Tsung Tsai, 364, Sec. 2, Mei Liao, Rd., Chu In Li, Ho Mei, Chang Hua (TW)

( * ) Notice: Subject to any disclaimer, the term of this patent is extended or adjusted under 35 U.S.C. 154(b) by 0 days.

(21) Appl. No.: 09/574,215

(22) Filed: May 19, 2000

(51) Int. Cl.[7] ..... B65H 18/04

(52) U.S. Cl. ..... 242/598.5; 242/588.6; D19/69

(58) Field of Search ..... 242/598.5, 598.3, 242/591, 588, 588.3, 588.6; D19/67, 68, 69, 75, 99, 100; 206/340, 341

(56) References Cited

U.S. PATENT DOCUMENTS

D. 254,556 * 3/1980 Johnson ..... D19/69
D. 322,990 * 1/1992 Samuelson .
D. 393,002 * 3/1998 Mandar .
3,727,868 * 4/1973 Buchanan .
3,892,369 * 7/1975 Fujawa .
4,919,276 * 4/1990 Kim et al. .
5,954,257 * 9/1999 Panneri et al. .

* cited by examiner

*Primary Examiner*—William A. Rivera
(74) *Attorney, Agent, or Firm*—Dougherty & Troxell

(57) ABSTRACT

A multi-use tape dispenser includes a housing with an open upper side, a tape dispenser body placed on the housing and secured with an upper engage circumferential edge of the housing engaging with a bottom engage circumferential edge of the tape dispenser body. Then small stationery items may be stored in a hollow space of the housing and expose to be taken out for use when the tape dispenser body is taken off the housing. The bottom of the housing has four suction discs engaged in four holes of the bottom of the housing to secure the tape dispenser on a table by suction.

5 Claims, 6 Drawing Sheets

COMBINATORIAL MULTI-USE TAPE DISPENSER

BACKGROUND OF THE INVENTION

This invention relates to combinatorial multi-use tape dispenser, particularly to one having various uses for containing small stationery items, not taking much space of a table surface.

A tape dispenser and a stationary case are common utensils in offices, placed on a table for ready use. A table surface for each employee may be often limited and not enough for placing various kinds of office utensils.

A known conventional tap dispenser 1 shown in FIG. 1 has an intermediate hollow space for placing a tape 2, which is pulled out from the dispenser 1 for use. To prevent the dispenser 1 from moving forward when pulling the tape 2 the bottom of the dispenser 1 has a hollow space 3 present for filling in something like sand 4 to make the dispenser 1 heavy so as not to be moved with the tape 2 pulled out. The bottom of the dispenser 1 is provided with two holes 5 to communicate with the hollow space 3 for filling in sand 4 therein and then sealed with a seal pads 6 to prevent sand 4 from leaking out. But this kind of manufacturing process is complicated and not convenient. In pulling out the tape 2, the dispenser 2 is often also pulled forward together if the pulling force is too large to surpass the weight of the dispenser 1, and then a hand has to be used to push the dispenser 1 immovable. In addition, the seal pads 6 are made of foam material liable to wear off for sand 4 to leak out.

SUMMRY OF THE INVENTION

The purpose of the invention is to offer a combinatorial multi-use tape dispenser having a tape dispenser body placed on a housing and a hollow space formed in the housing for containing small stationary items therein, saving needed dimensions for them on a table surface.

The invention includes a housing, a tape dispenser body placed on the housing and secured by engagement of an upper engage circumferential edge of the housing and a bottom engage circumferential edge of the tape dispenser body. The housing has an upper open side and a hollow rectangular space and preferably separated rooms formed in the hollow space for placing small stationery items such as clips, pins, rubber erasers, a paper knife, pens, etc., when the tape dispenser body is take off the housing, exposing small stationery items to be taken out.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
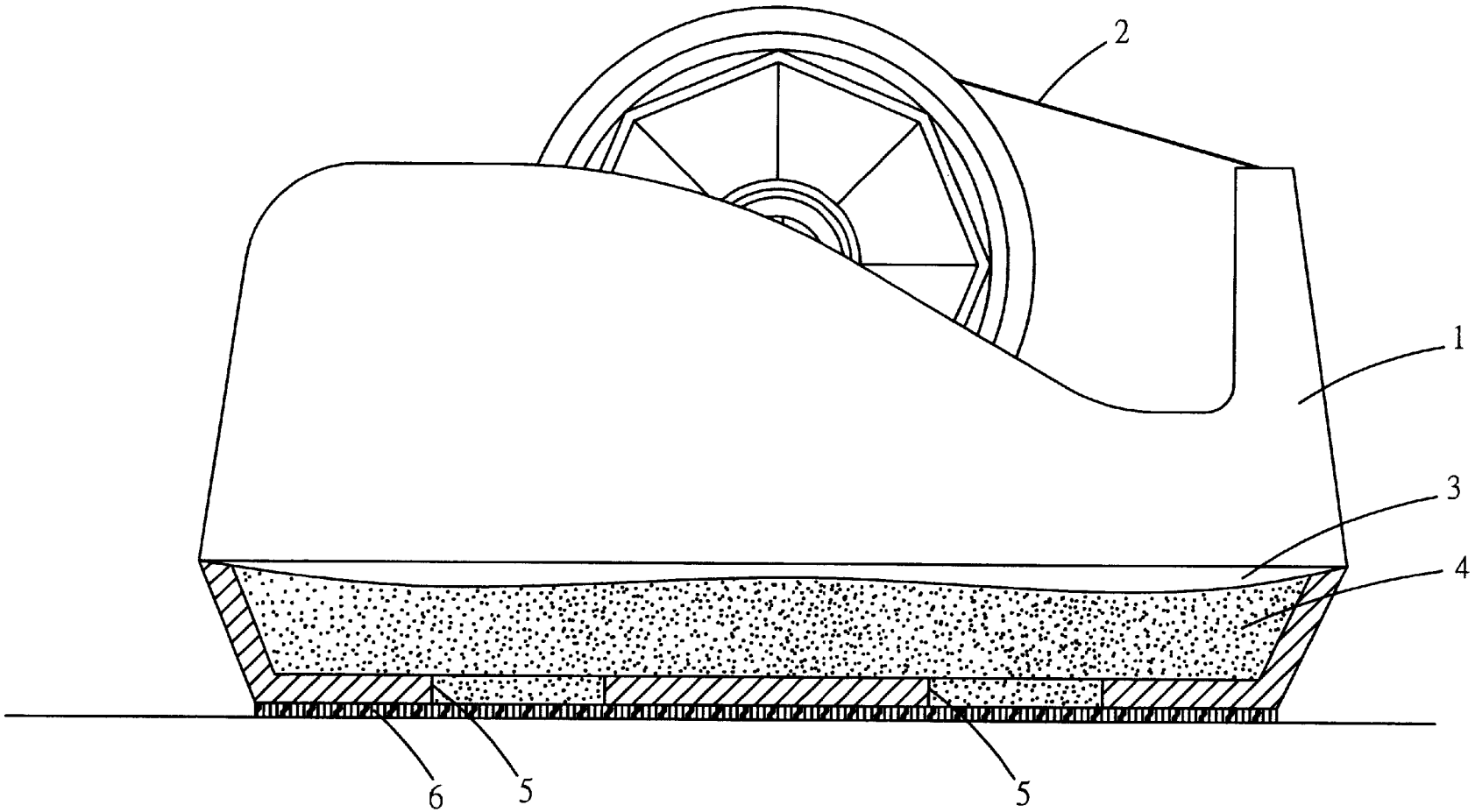
FIG. 1 (PRIOR ART)
FIG. 1 is a cross-sectional view of a known conventional tape dispenser.
Figure 2:
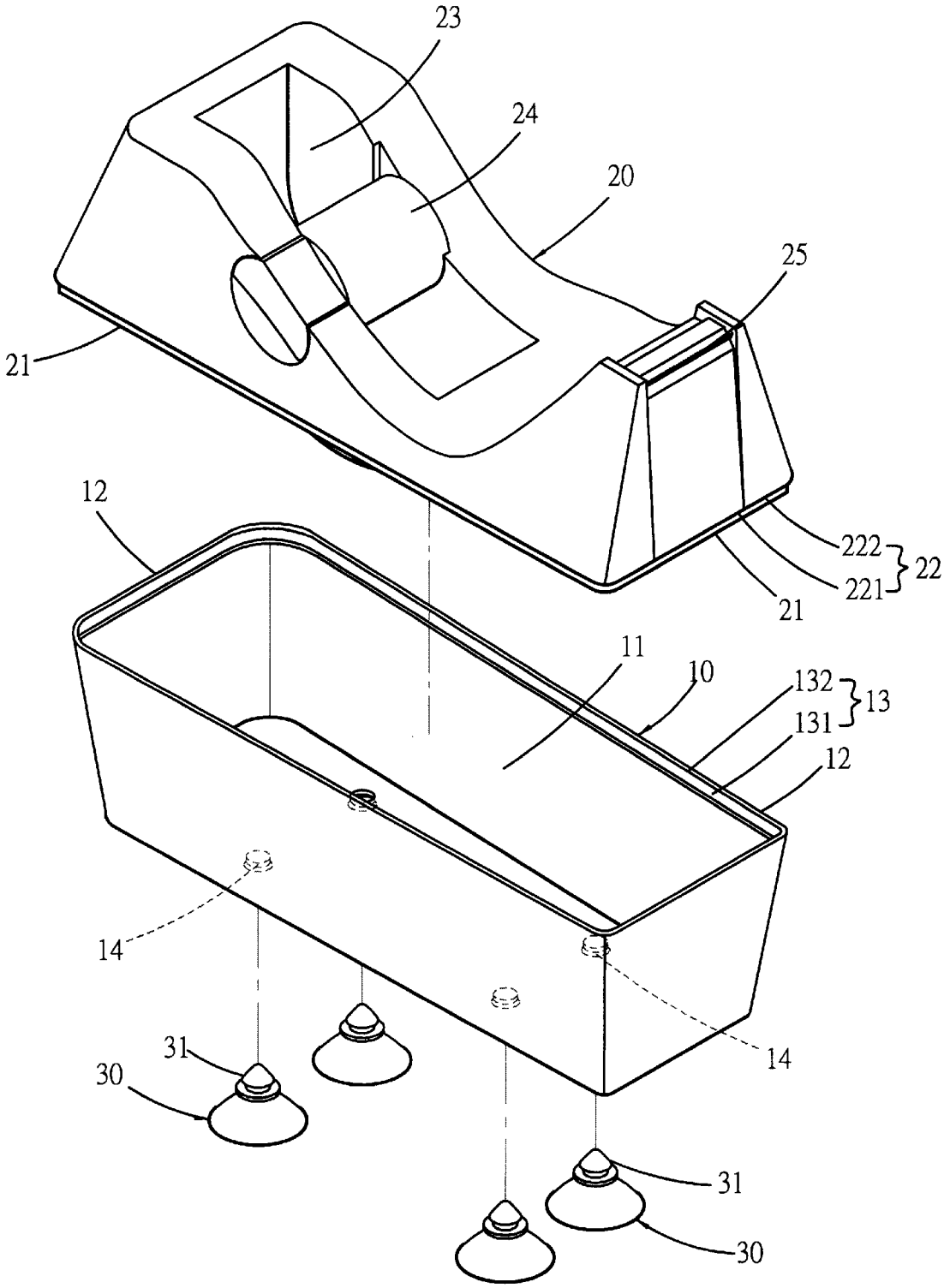
FIG. 2 is an exploded perspective view of a combinatorial multi-use tape dispenser in the present invention.
Figure 3:
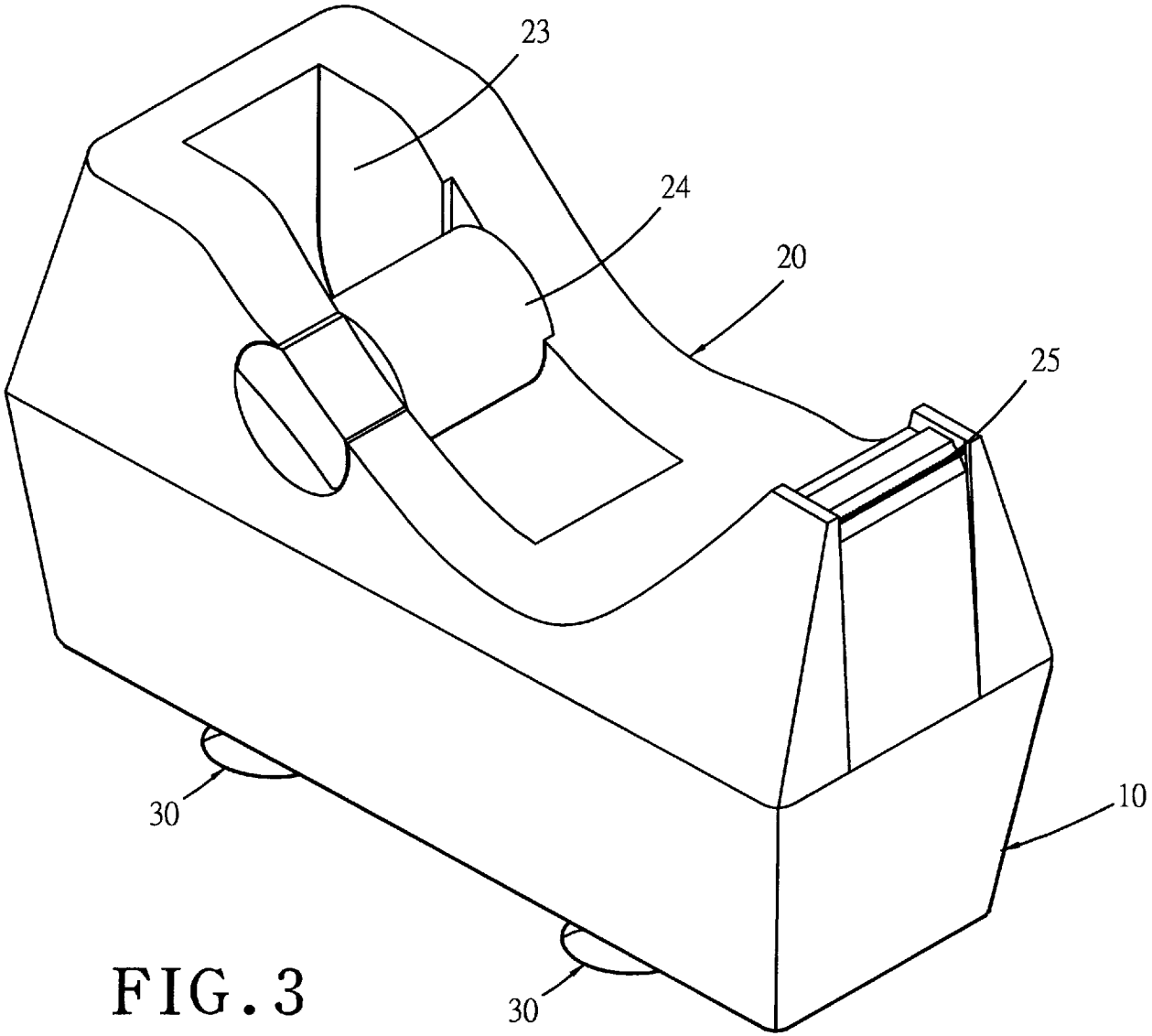
FIG. 3 is a perspective view of the combinatorial multi-use tape dispenser in the present invention.

A preferred embodiment of a combinatory multi-use tape dispenser in the present Invention, as shown in FIGS. 2 and 3, includes a housing 10 with an open upper side, a tape dispenser body 20, and four suction discs 30 as main components combined together.

The housing 10 is hollow rectangular with an open upper side, having a substantial hollow space 11, an engage circumferential portion 13 formed around an upper circumferential edge 12. The engage circumferential portion 13 has a L-shaped cross-section to have a vertical inner surface 131 and a horizontal stop surface 132. Two pairs of two aligned holes 14 are formed tapered in the bottom wall to corresponding to the four suction discs 30.

The tape dispenser body 20 is place on an upper edge of the housing 10, having an engage circumferential edge 22 formed around the lower circumferential edge 21, and the engage circumferential edge 22 has a L-shaped cross-section which has a vertical limit surface 221 and a horizontal stop surface 222. Then when the tape dispenser body 20 is placed on the upper edge of the housing 10, the vertical limit surface 221 contacts with the vertical limit surface 131 of the housing 10, and with the horizontal stop surface 222 rests on the horizontal stop surface 132. Thus the upper edge 12 of the housing 10 engages the bottom edge 21 of the tape dispenser body 20.

The four suction discs 30 respectively have an engage upper portion 31 of a cone-shape to fit smoothly and tightly in the holes 14 of the housing 20, securing the tape dispenser on a table surface 50 by sucking.

Figure 4:
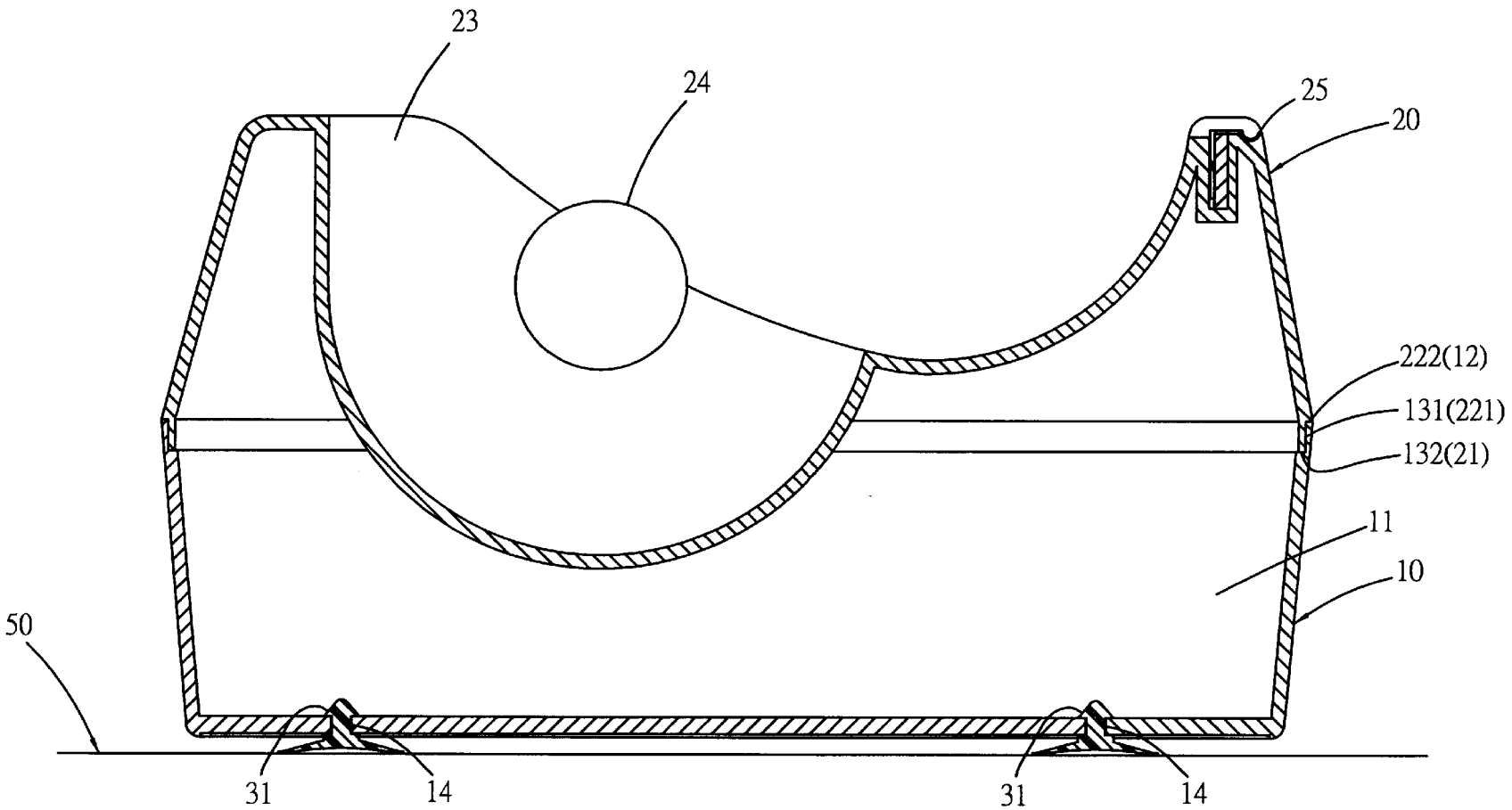
FIG. 4 is a cross-sectional view of the combinatorial multi-use tape dispenser in the present invention.
Figure 5:
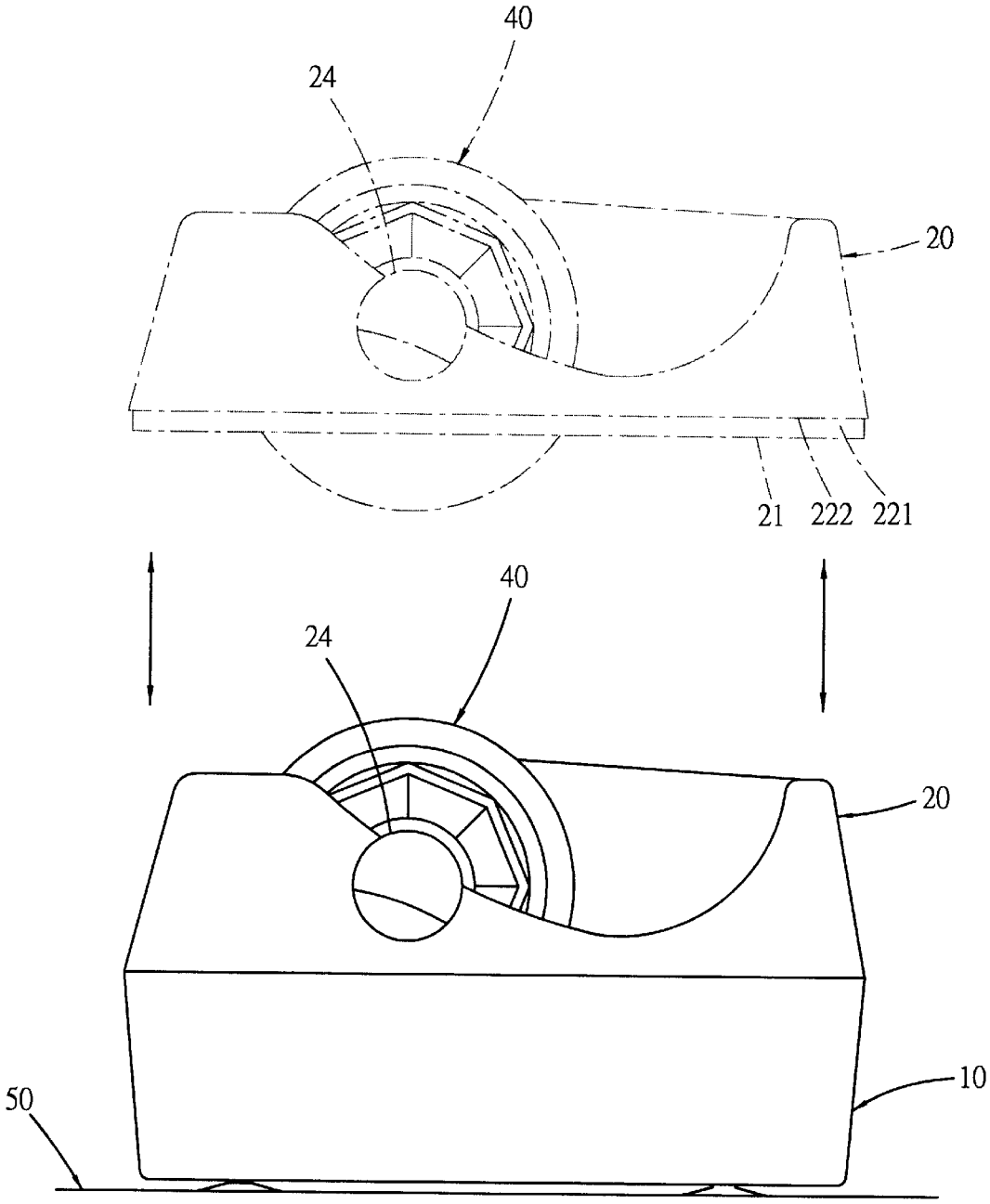
FIG. 5 is a side view of the combinatorial multi-use tape dispenser with the tape dispenser body swung up and leftward in the present invention: and, FIG. 6 is an exploded perspective view of the combinatorial multi-use tape dispenser added with a lengthwise separating plate and plural lateral separating plates on the bottom of the housing in the present invention.
Figure 6:
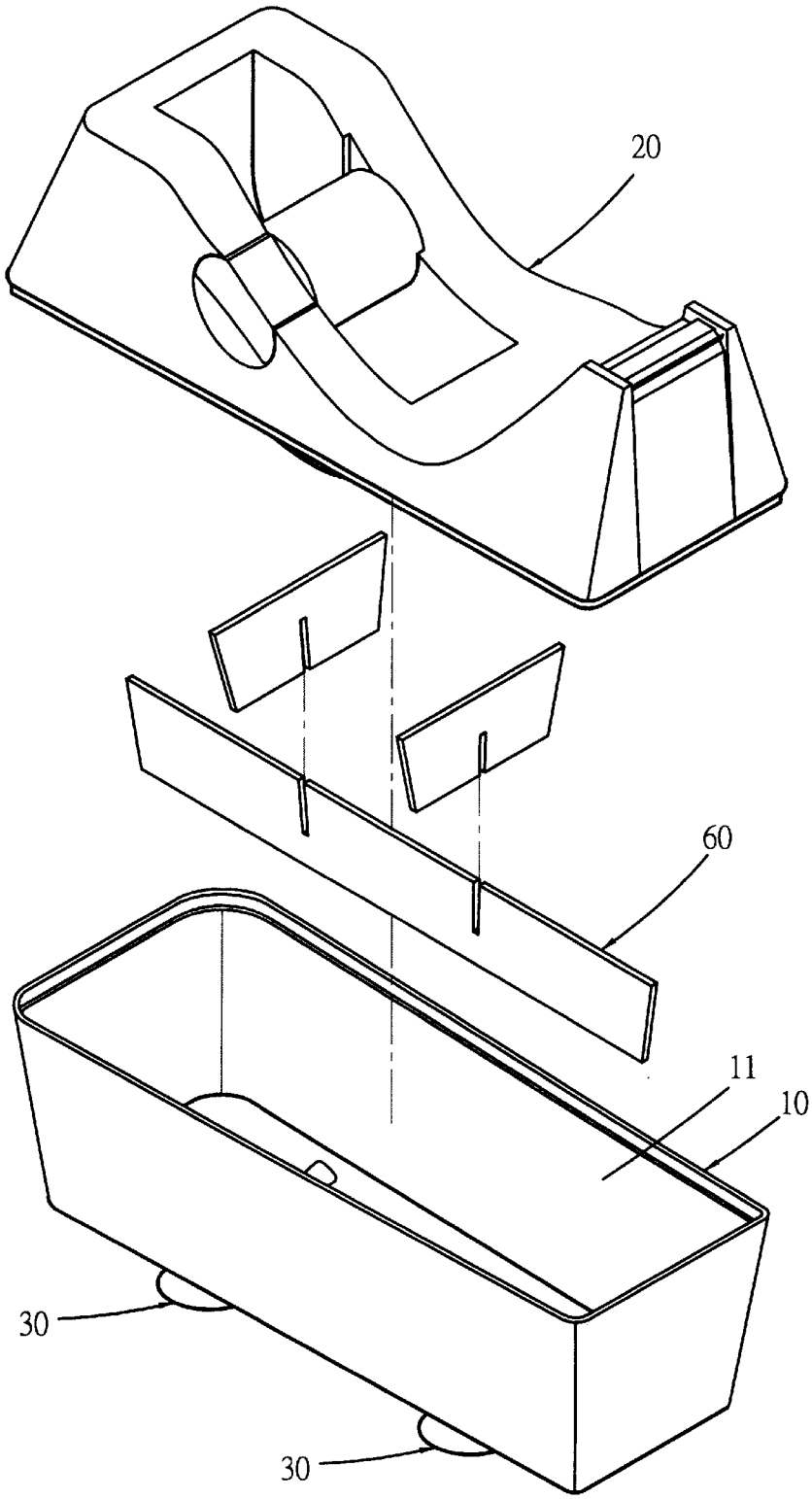

In using the tape dispenser, as shown in FIGS. 4 and 5, place it on a table surface 50, letting the four suction discs 30 flatly on the table surface 50 and press the four suction discs 30 down to let the air therein to flow out. Then the tape dispenser body 20 is placed on the housing 10, with the upper edge 12 of the housing engaging the bottom edge 21 of the tape dispenser body 20 in a stabilized condition. If something such as clips contained in the lower portion of the hollow space 11 is to be used, take manually the tape dispenser body 20 off the housing 10, In addition, as shown in FIG. 6, a present number of separation plates 60 longitudinal and lateral may be added in the lower portion of the hollow space 11 in the housing 10, defining plural small rooms to store various small stationery items therein for use.

The invention has the following advantages as can be understood from the aforesaid description.

1. It can contain various stationary small items such as pens, clips, pins, etc. for use, aside from the tape dispenser, saving dimensions for them to be placed on a table surface, having multi-use and easy to arrange the table surface.
2. It has four suction discs to secure the tape dispenser on a table, and so it may not move when the tape is pulled out for use, having no sand contained in the bottom to increase its weight. So it is lighter than the conventional ones, convenient to carry, and subsequently can save cost for transportation. Beside it does not use sand, simpler to assemble, or soil the table surface with no sand contained.

While the preferred embodiment of the invention has been described above, it will be recognized and understood that various modifications may be made therein and the appended claims are intended to cover all such modifications that may fall within the spirit and scope of the invention.

What is claimed is:

1. A multi-use tape dispenser comprising:

a) housing having a hollow, rectangular shape with an open upper side, a circumferential edge around the open upper side having an L-shaped cross-sectional configuration, the housing bounding a hollow space configured to store stationery items;

b) a plurality of suction discs attached to a bottom of the housing so as to mount the housing on a surface by suction; and, c) a tape dispenser body removably mounted on the housing so as to cover the open upper side, the tape dispenser body having a bottom circumferential edge removably engaging the upper circumferential edge of the housing.

2. The multi-use tape dispenser of claim 1 wherein the bottom circumferential edge of the tape dispenser body has an L-shaped cross-sectional configuration with a vertical limit surface and a horizontal stop surface.

3. The multi-use tape dispenser of claim 1 further comprising at least one separating plate located within the hollow space so as to divide the hollow space into a plurality of storage areas.

4. The multi-use tape dispenser of claim 3 further comprising a plurality of separating plates located within the hollow space.

5. The multi-use tape dispenser of claim 1 wherein the suction discs include an upper conical portion extending through a hole in the bottom of the housing.

* * * * *